US005241462A

United States Patent [19]

Sugimoto

[11] Patent Number: 5,241,462

[45] Date of Patent: Aug. 31, 1993

[54] LIGHTING EQUIPMENT ACCESSORY AND LIGHTING APPARATUS EQUIPPED WITH THE SAME

[76] Inventor: Jiro Sugimoto, 804 Rainbow-Mansion, 61, Sueyoshicho 3-chome, Naka-ku, Yokohama-shi, Kanagawa-ken, Japan

[21] Appl. No.: 821,655

[22] Filed: Jan. 16, 1992

[30] Foreign Application Priority Data

Jan. 17, 1991 [JP] Japan ..... 3-3666

[51] Int. Cl.[5] ..... F21V 5/02

[52] U.S. Cl. ..... 362/223; 362/224; 362/255; 362/331; 362/339

[58] Field of Search ..... 362/223, 255, 260, 339, 362/330, 331, 224, 268

[56] References Cited

U.S. PATENT DOCUMENTS

| | | | |
|---|---|---|---|
| 2,123,942 | 7/1938 | Gunsbourg | 362/255 |
| 2,523,394 | 9/1950 | Rolph et al. | 362/224 |
| 3,140,055 | 7/1964 | Long | 362/223 |
| 3,377,482 | 4/1968 | Podany | 362/255 |
| 4,488,208 | 12/1984 | Miller | 362/223 |
| 4,992,916 | 2/1991 | Henkes | 362/255 |

*Primary Examiner*—Richard R. Cole

*Attorney, Agent, or Firm*—Lowe, Price, LeBlanc & Becker

[57] ABSTRACT

A lighting equipment accessory comprising: one or more transparent bodies for directing at least part of the light, which is incident from a lighting equipment in a first predetermined direction, in a second predetermined direction; and a support supporting the one or more transparent bodies in such a manner that light emitted sidewardly from the lighting equipment is directed downwardly by the one or more transparent bodies.

14 Claims, 14 Drawing Sheets

LIGHTING EQUIPMENT ACCESSORY AND LIGHTING APPARATUS EQUIPPED WITH THE SAME

BACKGROUND OF THE INVENTION

1. Field of the Invention

This invention relates to a lighting equipment accessory to be attached around a lighting equipment.

2. Description of the Related Art

As shown in FIG. 14 of the accompanying drawings, in many of conventional interior lighting apparatuses, a shade 2 covers the top and sides of a fluorescent tube 1 so that light emitted upwardly and sidewardly from the fluorescent tube 1 is directed downwards to increase the luminance such as onto a floor in a room.

However, with the conventional lighting apparatus, since almost no light can reach the ceiling 3, the ceiling 3 becomes dark so that an occupant might feel anxiety and also the increased contrast in brightness between the floor and the ceiling 3 might strain the eyes of an occupant. This would be a serious problem particularly in a living room where people are intending to make themselves comfortable.

SUMMARY OF THE INVENTION

It is therefore an object of this invention to provide a lighting equipment accessory with which directions, such as the ceiling side, other than the primary direction of a light equipment, such as the floor side, can be made bright, while still securing an adequate degree of brightness in the primary direction of the lighting equipment.

According to a first aspect of the invention, there is provided a lighting equipment accessory comprising: one or more transparent bodies for directing at least some of the light, which is incident from a lighting equipment in a first predetermined direction, in a second predetermined direction; and a support supporting said one or more transparent bodies in such a manner that light emitted sidewardly from the lighting equipment is directed downwardly by said one or more transparent bodies.

According to a second aspect of the invention, there is provided a lighting equipment accessory comprising: one or more transparent bodies for directing at least part of light, which is incident from a light equipment in a first predetermined direction, in a second predetermined direction perpendicular to said first predetermined direction; and a support supporting said one or more transparent bodies in such a manner that light emitted from the lighting equipment substantially perpendicularly to a primary lighting direction of the lighting equipment is directed substantially in said primary light direction by said one or more transparent bodies.

The transparent body may have a cross sectional shape of a right-angled isosceles triangle, an equilateral triangle or a pentagon, or it may include two members which each have a cross sectional shape of a right-angled triangle and are in contact with each other's diagonal surface. Further, the transparent body may contain a fluorescent material. Preferably the transparent body should be treated at its upper (when the transparent body is positioned perpendicularly to the primary lighting direction of the lighting equipment) surfaces by an antielectrostatic process. Furthermore the plurality of transparent bodies may be supported by the support in such a manner that the transparent bodies are positioned to the side of the lighting equipment in parallel to one another in the horizontal and/or vertical directions.

Still further, the support may have an attachment adapted to attach the support itself to the lighting equipment.

In operation, light emitted from the upper surface of the lighting equipment shines directly on the ceiling. Light from the side surface of the lighting equipment is directed downwardly by the transparent body to shine the floor. Light from the lower surface of the lighting equipment shines directly on the floor.

According to this invention, since light from the side surface of the lighting equipment is directed to the floor without using a shade which can shield light perfectly, it is possible to make the whole of the room bright, while still securing an adequate degree of brightness on the floor.

Even if a shade for shielding light is used, it is possible to make the whole of the room bright such as by directing light in the shielded direction using the transparent body.

DETAILED DESCRIPTION OF THE PREFERRED EMBODIMENTS

Various embodiments of this invention will now be described with reference to FIGS. 1 through 13.

Figure 1:
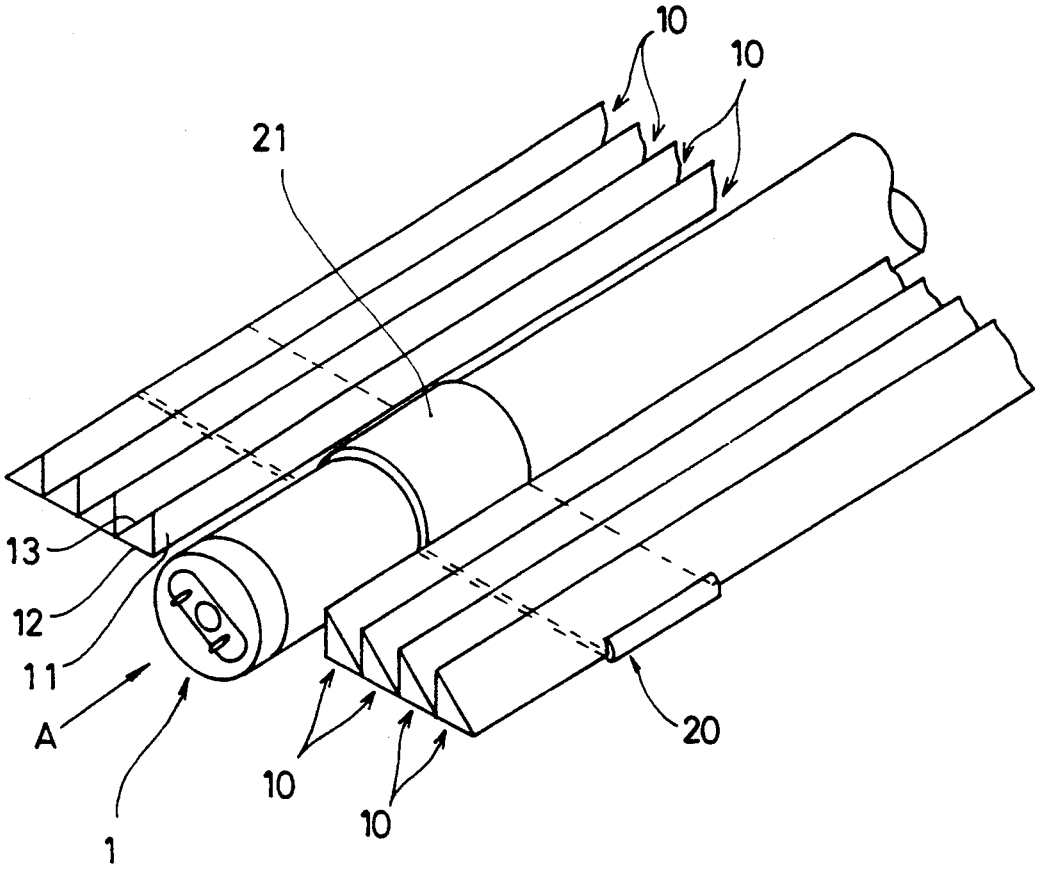
FIG. 1 is a fragmentary perspective view showing a lighting equipment accessory according to a first embodiment of this invention.
Figure 2:
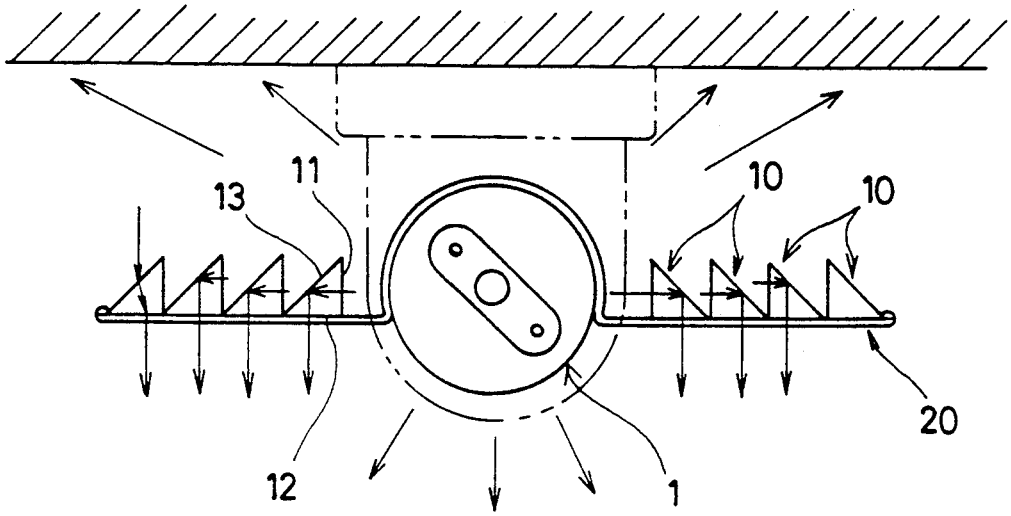
FIG. 2 is a view as seen in direction A of FIG. 1.

FIGS. 1 and 2 show a lighting equipment accessory according to a first embodiment.

The lighting equipment accessory, as shown in FIG. 1, comprises a plurality of transparent bodies 10, each having cross section of a right-angled isosceles triangle, and a support 20 supporting the transparent bodies 10 in such a manner that the transparent bodies 10 are arranged to the side of a fluorescent lamp 1, which is used as a lighting equipment in parallel to each other in the sideward direction.

The transparent bodies 10 are made of acryl resin. Each transparent body 10 is supported by the support 20 in such a manner that one 11 of two surfaces meeting at a right angle faces sideways and the other surface 12 faces downwards.

The support 20 has an attachment 21 adapted to attach the support 20 itself to the fluorescent lamp 1. Although only a single support 20 is illustrated here in the drawings, there are practically provided a plurality of supports to secure the stability of the transparent bodies 10.

In operation, after the lighting equipment accessory has been attached to the fluorescent lamp 1, power is turned on.

Light emitted from the lower surface of the fluorescent lamp 1 travels in a straight line and reaches the floor in a room. Light emitted from the side surface of the fluorescent lamp 1 is incident on one surface 11 of each transparent body 10, and part of the light is reflected on a slant surface 13 of the transparent body 10 and is then emitted from the other surface 12 to reach the room floor. Meanwhile the remaining part of the light incident on the one surface 11 of the transparent body 10 is emitted from the slant surface 13 of the transparent body 10 to travel toward the adjacent transparent body 10 and the ceiling.

Light emitted from the upper surface of the fluorescent lamp 1 travels directly to the ceiling. The light which reaches the ceiling is reflected thereon and then part of the light is incident on the transparent body 10. Also part of the light incident onto the transparent body 10 shines on the floor.

In this embodiment, since the ceiling is shined directly by the light from the upper surface of the fluorescent lamp 1, some degree of brightness on the ceiling can be secured. Further since the floor is illuminated by not only the light from the lower surface of the fluorescent lamp 1 but also the light from the side surface of the fluorescent lamp 1, an adequate degree of brightness on the floor can be secured. Partly since a small quantity of light passing through the plural transparent bodies 10 reaches the sidewalls of the room and partly since the sidewalls are illuminated by the reflected light from other surfaces of the room, there is no possibility that part of the sidewalls will become very dark. Thus it is possible to make the ceiling and the sidewalls bright, while, securing adequate brightness on the floor.

In this embodiment, the primary light direction is the floor side, i.e., the downward direction. However this invention should by no means be limited to the illustrated example; if the primary lighting direction is the obliquely downward direction such as in a desk or floor lamp, the lighting equipment accessory may be inclined in such a manner that the other surface 12 of the transparent body 10 faces in the obliquely downward direction.

Figure 3A:
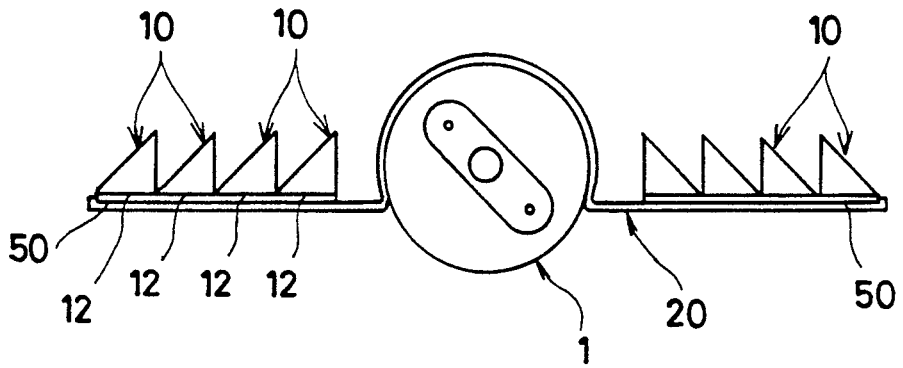
FIGS. 3(*a*) and 3(*b*) are side views showing modified lighting equipment accessories according to second and third embodiments in which transparent bodies are connected to one another in alternative forms.
Figure 3B:
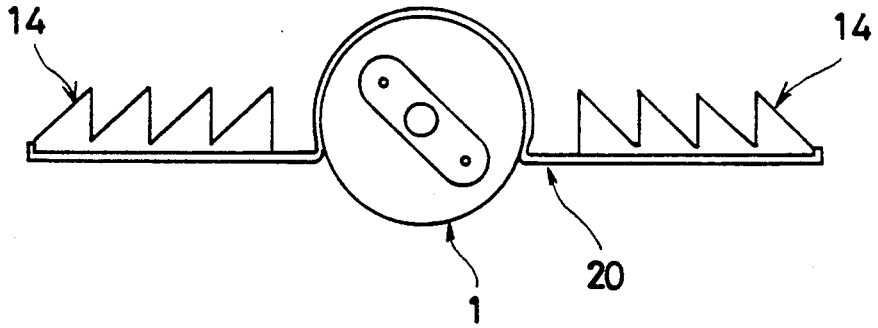

FIGS. 3(*a*) and 3(*b*) show second and third embodiments in which the transparent bodies 10 are connected to one another in alternative ways different from the first embodiment.

In the first embodiment, the transparent bodies 10 are connected to one another by simply supporting them on the support 20. Alternatively a succession of transparent plates 50 are attached one to the other surface 12 of each of the transparent bodies 10, as shown in FIG. 3(*a*). In the other alternative way, a succession of laterally arranged transparent bodies, each in the form of a prism having a right-angled isosceles triangular cross section, may be integrally formed with one another as a unified transparent body 14.

Figure 4A:
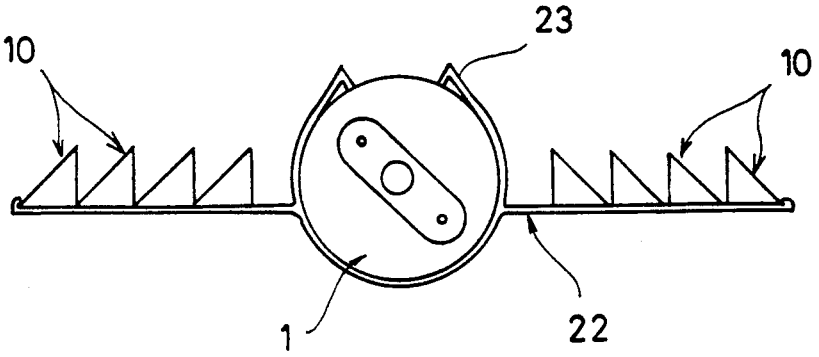
FIGS. 4(*a*) and 4(*b*) are side views showing further modified lighting equipment accessories according to fourth and fifth embodiments in which alternative supports are used.
Figure 4B:
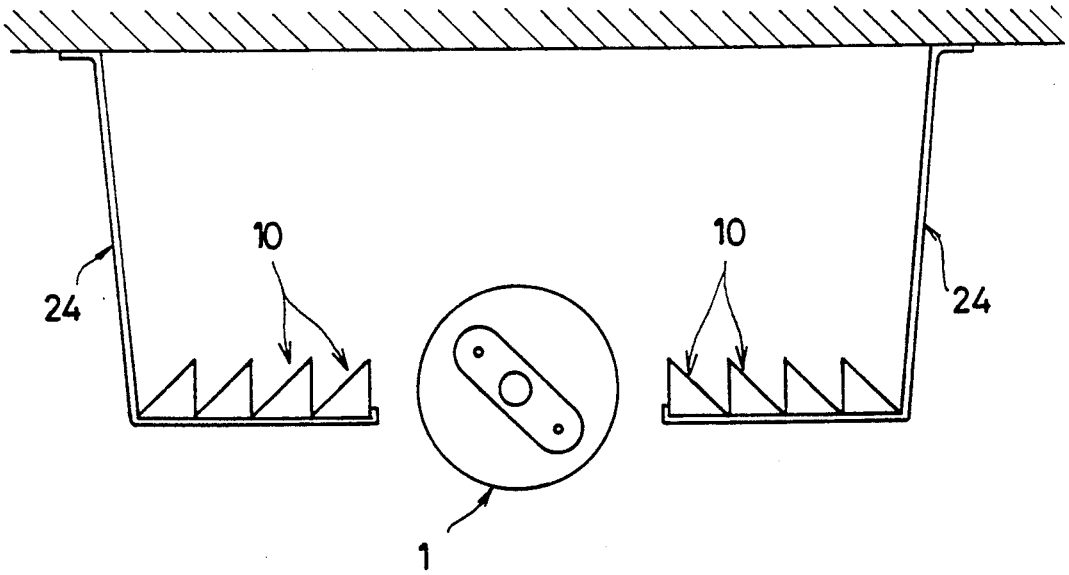

FIGS. 4(*a*) and 4(*b*) show fourth and fifth embodiments in which the support is modified.

In the first embodiment, the support 20 itself is attached to the fluorescent lamp 1 at its upper side, supporting thereon the transparent bodies 10. Alternatively the support 20 may be attached to the fluorescent lamp 1 at its lower side, as shown in FIG. 4(*a*); that is, a modified support 22 may have an attachment 23 adapted to be fitted on the fluorescent lamp 1 and having an upward opening. Having such attachment 23, it is possible to attach the lighting equipment accessory to the fluorescent lamp 1 even after the latter has been attached to the ceiling, for example. In the other alternative way, a modified support 24 may be attached to the ceiling, for example, as shown in FIG. 4(*b*).

The supports 20, 23, 24 should preferably be transparent so that light from the fluorescent lamp 1 can be utilized more effectively. Further the support may be formed of a transparent material integrally formed with the transparent bodies.

Figure 5A:
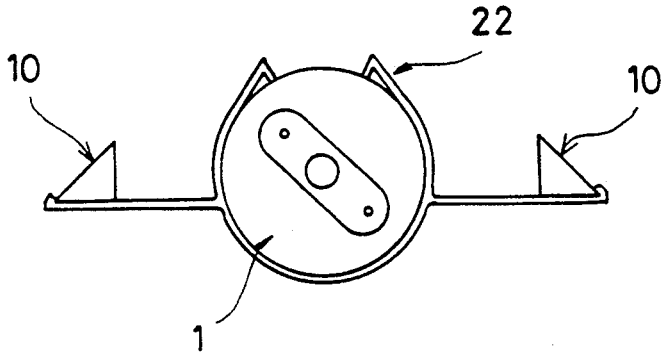
FIGS. 5(*a*) and 5(*b*) are side views showing still further modified lighting equipment accessories according to sixth and seventh embodiments in which the number of the transparent bodies is different.
Figure 5B:
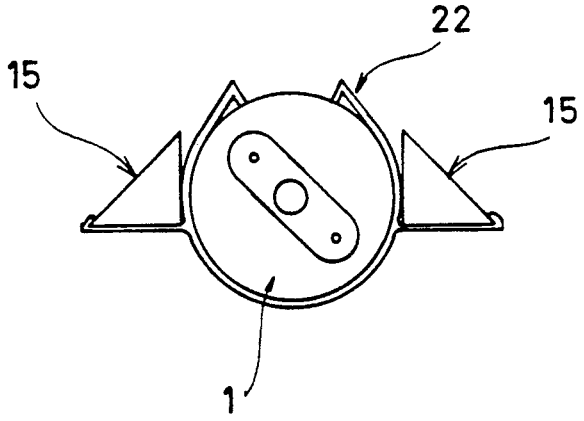

FIGS. 5(*a*) and 5(*b*) show sixth and seventh embodiments in which the number of transparent bodies is different from that in the first embodiment.

In the first embodiment, four transparent bodies 10 are provided on each side of the fluorescent lamp 1. Alternatively, one transparent body 10 is provided on each side of the fluorescent lamp 1.

The number of the transparent bodies should be determined, depending on the designing conditions as to what quantity of light from the side surface of the fluorescent lamp 1 should be directed toward the floor and also depending on the ornamental conditions as to how the lighting apparatus should look. Therefore in view of the environment, two or six transparent bodies 10 may be provided on each side of the fluorescent lamp 10. In another alternative form, one transparent body 10 may be provided one on one side of the fluorescent lamp 1 and three on the other side.

To direct as much light as possible from the side surface of the fluorescent lamp 1 by a minimum number of transparent bodies, one relatively large transparent body 15 on each side of the fluorescent lamp 1, may be used, as shown in FIG. 5(*b*).

Figure 6A:
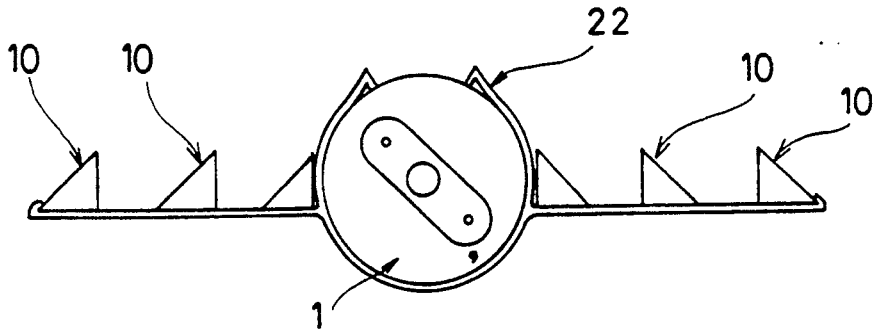
FIGS. 6(*a*) and 6(*b*) are side views showing still further modified lighting equipment accessories according to eighth and ninth embodiments in which the transparent bodies are arranged in alternative ways.
Figure 6B:
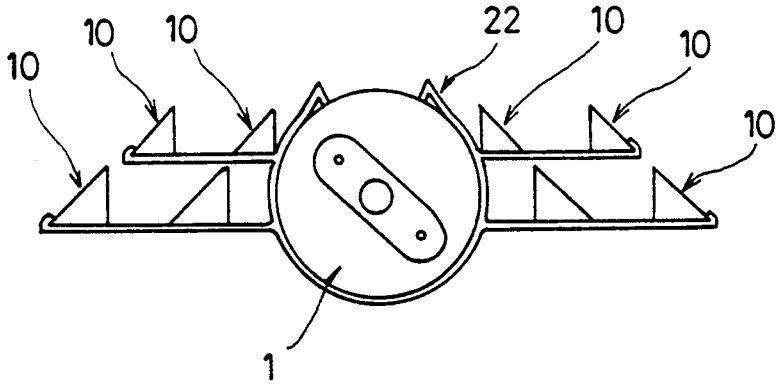

FIGS. 6(*a*) and 6(*b*) show eighth and ninth embodiments in which the transparent bodies 10 may be arranged in alternative ways.

In the first embodiment, the transparent bodies 10 are connected to one another. Alternatively, from an ornamental view point, transparent bodies 10 may be arranged a certain distance apart, as shown in FIG. 6(*a*).

The intertransparentbody space may be provided every two transparent bodies.

To direct as much light as possible from the side surface of the fluorescent lamp 1, the transparent bodies 10 may be arranged divided into upper and lower groups on each side of the fluorescent lamp 1, as shown in FIG. 6(*b*).

Assuming that a plurality of fluorescent lamps 1 are to be arranged parallel to one another, it would be preferable to arrange the transparent bodies 10 between the fluorescent lamps 1.

The transparent bodies may be different in size and/or shape.

Figure 7A:
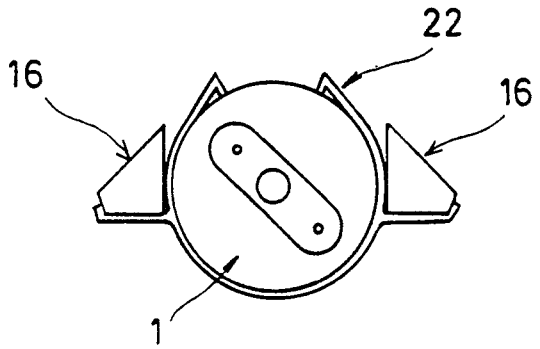
FIGS. 7(*a*), 7(*b*), 8(*a*) and 8(*b*) are side views showing still further modified lighting equipment accessories according to tenth, eleventh, twelfth and thirteenth embodiments in which the transparent bodies have alternative shapes.
Figure 7B:
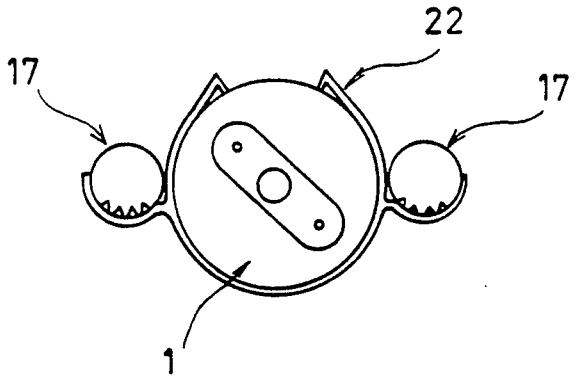

FIGS. 7(*a*), 7(*b*), 8(*a*) and 8(*b*) show tenth, eleventh, twelfth and thirteenth embodiments in which the transparent bodies have alternative shapes.

As shown in FIG. 7(*a*), transparent bodies 16 may be quadrangular in cross section. The shape of the transparent body may be determined particularly from a designing view point as to which direction the light from the side surface of the fluorescent lamp 1 is to be directed in. As shown in FIG. 7(*a*), in the case where the transparent bodies 16 are substantially in contact with the fluorescent lamp 1, the fluorescent lamp 1 cannot be exchanged easily as it is obstructed by the transparent bodies 10. Consequently it is preferable to form several cutouts at distances along the transparent bodies 10 so that the fingers of a workperson can be inserted into the cutouts.

In another alternative form, modified transparent bodies 17 each being circular in cross section and having longitudinally extending circumferential grooves may be used. The grooves may be formed on at least part of the circumferential surface of the transparent body 10, or may be formed spirally. The grooves does not serve to direct the light from the side surface of the fluorescent lamp 1 in a predetermined direction but serves to diffuse that light in many directions, thus causing an ornamental effect.

Figure 8A:
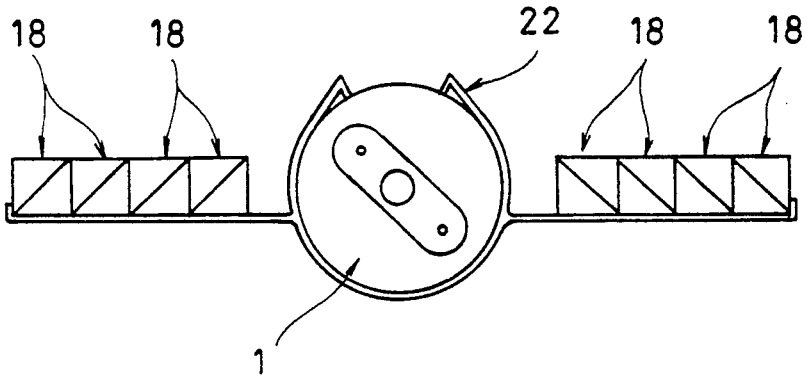
Figure 8B:
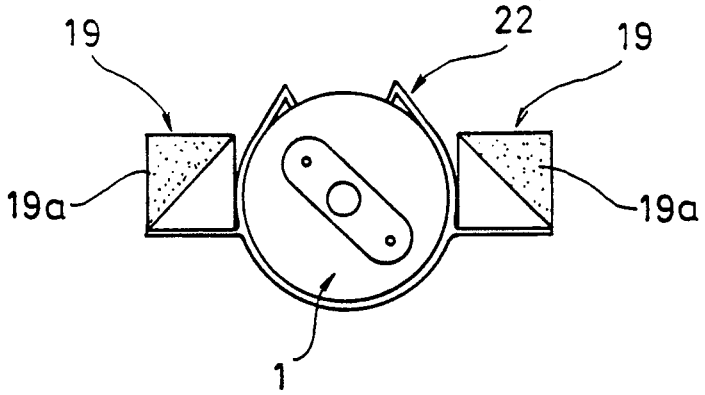

In still another alternative form, modified transparent bodies 18 each being composed of two right-angled isosceles triangular members joined with their diagonal surface may be used, as shown in FIG. 8(*a*). In this case, transparent bodies 19 containing a fluorescent material in one 19*a* of two members of each transparent body may be used. Since the transparent bodies 18, 19 shine in a color corresponding to the kind of the fluorescent material, it is possible to change the atmosphere in the room remarkably. In each of the foregoing embodiments, the fluorescent material may be contained in part or all of the transparent bodies.

Figure 9:
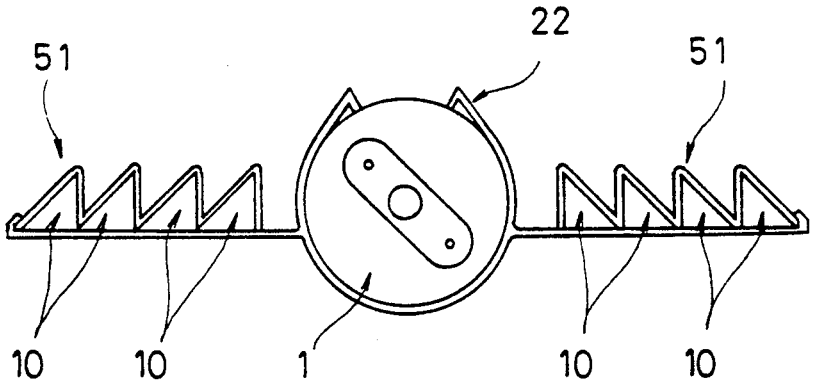
FIG. 9 is a side view showing a still further modified lighting equipment accessory according to a fourteenth embodiment in which the transparent bodies are treated by an antielectrostatic process.

When this lighting equipment accessory is used for a long time, dust or the like will stick to the transparent bodies at their surfaces facing the ceiling. FIG. 9 shows a fourteenth embodiment which prevents this problem as follows.

In this embodiment, an antielectrostatic film 51 which allows light to pass through is attached to the transparent bodies 10 at their surfaces facing the ceiling, thus preventing dust or the like from electrically sticking on such upward surfaces. Alternatively an antielectrostatic material may be painted over the upward surfaces of the transparent bodies or may be contained in the transparent bodies.

Figure 10:
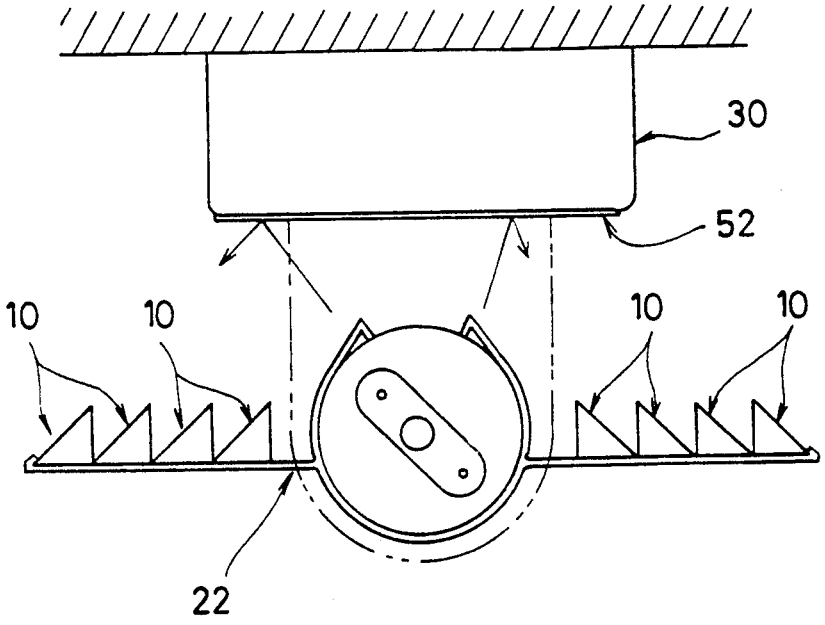
FIG. 10 is a side view showing a lighting apparatus according to a fifteenth embodiment.

FIG. 10 shows a lighting apparatus according to a fifteenth embodiment. Basically a lighting apparatus is constructed by attaching the lighting equipment accessory according to the foregoing embodiments to a lighting equipment, i.e., the fluorescent lamp 1. In this embodiment, the amount of light directed to the floor is increased.

Specifically an aluminum foil 52 having a high reflectivity is attached to a fluorescent lamp support 30 at its surface facing the fluorescent lamp 1 for reflecting the light from the upper surface of the fluorescent lamp 1 so that it shines on the floor.

Alternatively a reflector integrally formed with the support 22 may be located between the fluorescent lamp support 30. In another alternative way, a high-reflectivity paint may be coated over the fluorescent lamp support 30 at its surface facing the fluorescent lamp 1. In still another alternative way, the surface of the fluorescent lamp support 30 may be processed so as to be a mirrored surface, thus securing an increased degree of reflectivity.

Assuming that the ceiling is provided with a reflective surface, substantially the same results can be obtained even if the other surface 12 of the transparent body 10 is directed upwardly, namely, even if the lighting equipment accessory according to the foregoing embodiments is positioned upside down. In this case, the light from the side surface of the fluorescent lamp 1 is incident from one surface 11 of the transparent body 10, is reflected by the slant surface 13 and is then emitted from the other surface 12 to travel upwardly. Then this light is reflected by the reflective surface on the ceiling to shine the floor.

Figure 11:
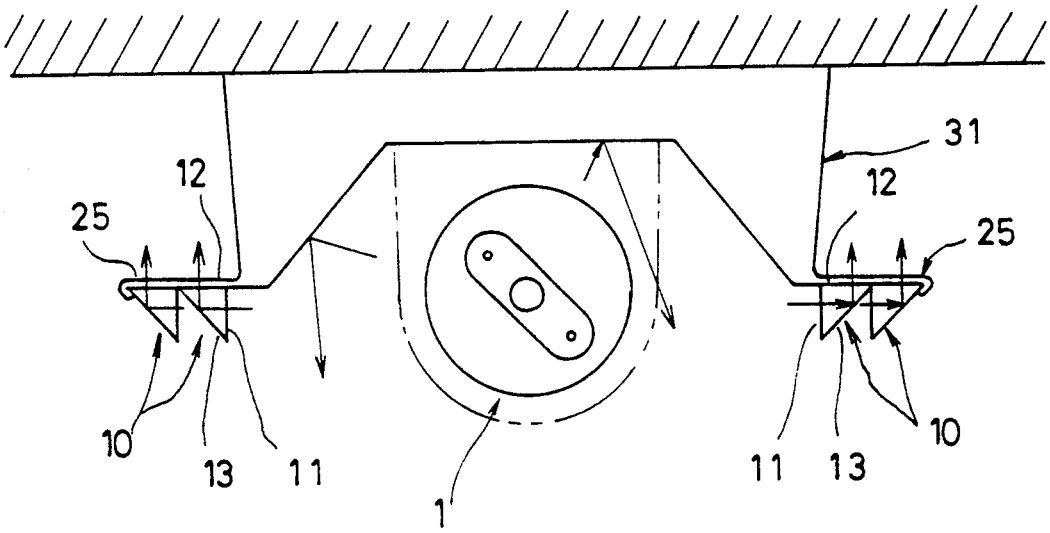
FIG. 11 is a side view showing a modified lighting apparatus according to a sixteenth embodiment.

FIG. 11 shows a lighting apparatus according to a sixteenth embodiment.

The lighting apparatus of this embodiment comprises a fluorescent lamp 1, a shade 31 covering the upper side of the fluorescent lamp 1 for reflecting the light from the fluorescent lamp 1 toward the floor, a plurality of transparent bodies 10 each having a right-angled isosceles triangular cross section, and a support 25 supporting the transparent bodies 10 in such a manner that the transparent bodies 10 direct the light from the side surface of the fluorescent lamp 1 toward the ceiling.

Each transparent body 10 is supported at the end of the shade 31 by the support 25 in such a manner that one 11 of two surfaces meeting at a right angle faces to the side of the fluorescent lamp 1 and the other surface 12 faces upwards.

Light from the upper surface of the fluorescent lamp 1 is reflected by the shade 31 to shine on the floor. Light from the side surface of the fluorescent lamp 1 is incident on one surface 11 of the transparent body 10, is reflected by the diagonal surface 13, and is emitted from the other surface 12 to shine on the ceiling.

Thus even though both the shade 31 and the transparent bodies 10 are used, it is possible to make the ceiling bright, while securing an adequate degree of brightness on the floor.

Figure 12:
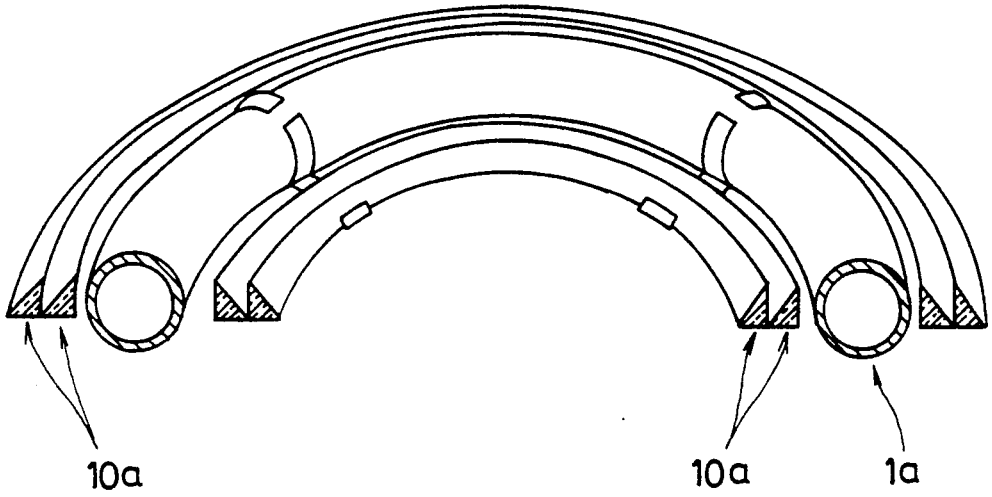
FIG. 12 is a fragmentary perspective view showing a still further modified lighting equipment accessory according to an seventeenth embodiment.
Figure 13:
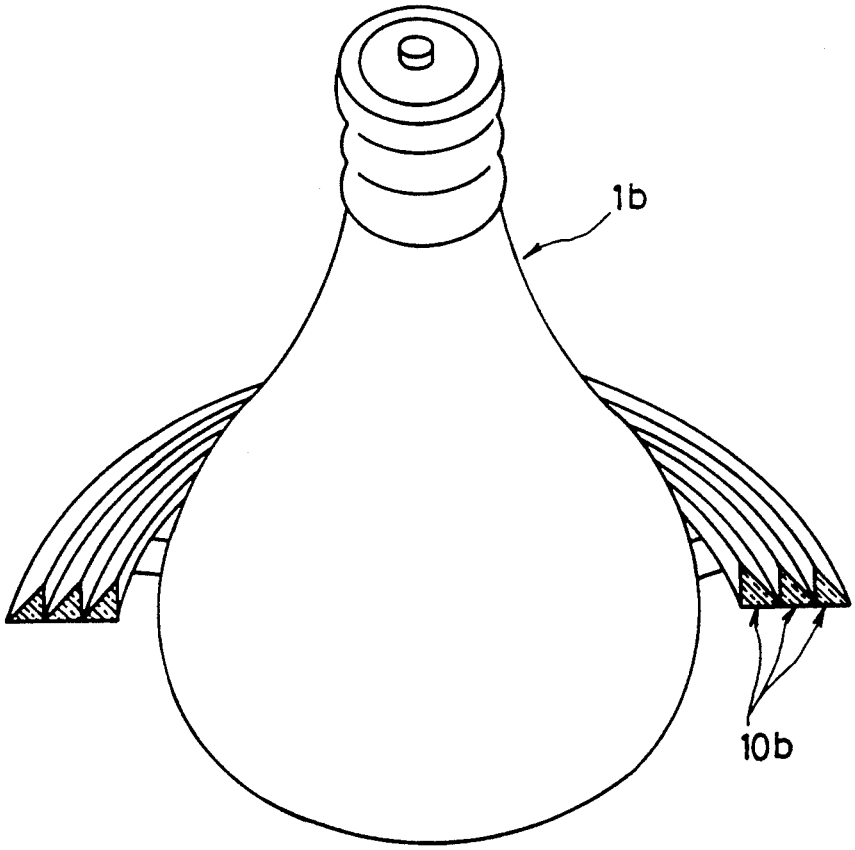
FIG. 13 is a fragmentary perspective view showing a still further modified lighting equipment accessory according to a eighteenth embodiment.
Figure 14:
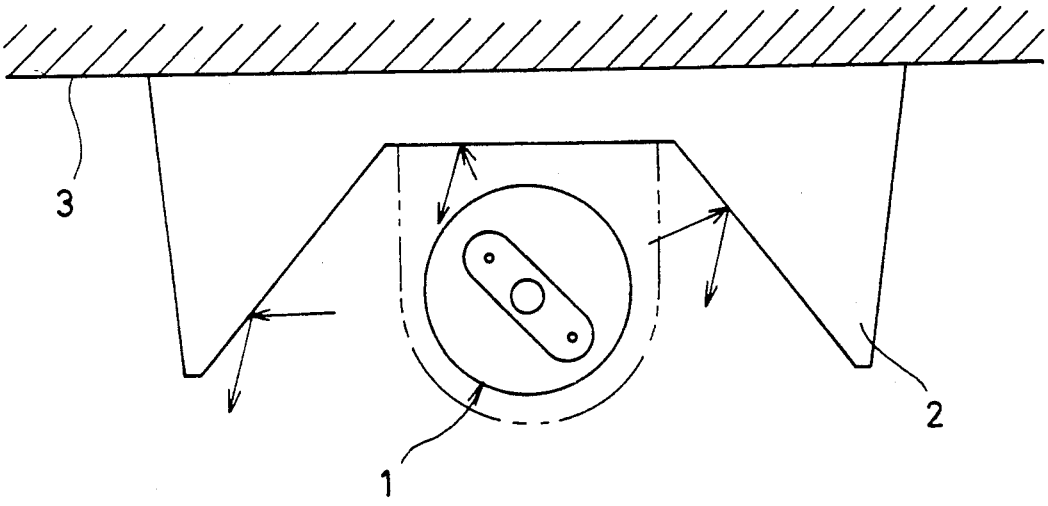
FIG. 14 PRIOR ART
FIG. 14 is a side view showing a conventional lighting apparatus.

In the foregoing embodiments, the fluorescent lamp 1 is in the form of a tube having a circular cross section. This invention should by no means be limited to the illustrated specific form; for example, annular transparent bodies 10*a* may be provided on both sides of an annular fluorescent lamp 1*a*, as shown in FIG. 12. Further annular transparent bodies 10*b* may be provided around a substantially spherical bulb 1*b*, as shown in FIG. 13.

According to this invention, since the transparent bodies for directing the light, which is incident from a first predetermined direction, in a second predetermined direction are positioned to the side of the lighting equipment, directions, such as the ceiling side, other than the primary direction of the light equipment, such as the floor side, can be made bright, while securing an adequate degree of brightness in the primary direction. Therefore it is possible to make all surfaces in the room bright and also to increase the brightness in the primary lighting direction.

What is claimed is:

1. A lighting equipment accessory comprising:

(a) a plurality of transparent bodies, each arranged to direct a first portion of incident light, which has been emitted in a first predetermined direction from a light source, in a second predetermined direction perpendicular to said first predetermined direction; and (b) support means for supporting said plurality of transparent bodies and positioning said transparent bodies substantially perpendicularly to a selected primary illumination direction of said light source;

wherein said second predetermined direction is generally parallel to said selected primary illumination direction; and said plurality of transparent bodies are parallel with one another, such that a second portion of incident light, different from said first portion of incident light and incident from said first predetermined direction, passes through one of said plurality of transparent bodies to interact with another of said plurality of transparent bodies.

2. A lighting equipment accessory according to claim 1, wherein each of said plurality of transparent bodies includes a pair of members;

wherein each of said pairs of members comprises a perpendicular surface and a diagonal surface arranged to have a right-angled triangular cross section; and each of said pairs of members contacts an adjacent pair of members other at a diagonal surface of said adjacent pair of members.

3. A lighting equipment accessory according to claim 1, wherein said plurality of transparent bodies are parallel to one another.

4. A lighting equipment accessory according to claim 3, wherein said support means includes an attachment adapted to attach said support means to said light source.

5. A lighting equipment accessory according to claim 3, wherein at least one surface of each of said plurality of transparent bodies is treated with an antielectrostatic film.

6. A lighting equipment accessory according to claim 3, wherein said plurality of transparent bodies contain a fluorescent material.

7. A lighting equipment accessory according to claim 1, wherein said plurality of transparent bodies each has a triangular cross section.

8. A lighting equipment accessory according to claim 7, wherein at least one surface of each of said plurality of transparent bodies is treated with an antielectrostatic film.

9. A lighting equipment accessory according to claim 7, wherein said plurality of transparent bodies contain a fluorescent material.

10. A lighting equipment accessory according to claim 1, wherein said plurality of transparent bodies contain a fluorescent material.

11. A lighting equipment accessory according to claim 1, wherein said support means includes an attachment adapted to attach said support means to a structural surface adjacent said light source.

12. A lighting equipment accessory according to claim 1, wherein said plurality of transparent bodies are in at least two parallel planes outwardly projecting from said source; and said transparent bodies, located in a particular one of said parallel planes, are arranged parallel to each other.

13. A lighting equipment accessory according to claim 1, wherein said support means includes an attachment adapted to attach said support means to said light source.

14. A lighting equipment accessory according to claim 1, wherein at least one surface of each of said plurality of transparent bodies is treated with an antielectrostatic film.

* * * * *